US005332326A

United States Patent [19]

Hori

[11] Patent Number: 5,332,326

[45] Date of Patent: Jul. 26, 1994

[54] WRITING INSTRUMENT

[76] Inventor: Jiro Hori, 61-2, Kamihiroya, Tsurugashima-shi, Saitama-ken, Japan

[21] Appl. No.: 922,380

[22] Filed: Jul. 31, 1992

[30] Foreign Application Priority Data

Feb. 17, 1992 [JP] Japan ..... 4-029245
Jul. 15, 1992 [JP] Japan ..... 4-187709

[51] Int. Cl.[5] ..... B43K 5/18

[52] U.S. Cl. ..... 401/148; 401/206; 401/264; 401/273

[58] Field of Search ..... 401/176, 145, 148, 206, 401/205, 235, 264, 272, 273, 263, 219

[56] References Cited

U.S. PATENT DOCUMENTS

| | | | |
|---|---|---|---|
| 2,762,337 | 9/1956 | Beckwith | 401/148 |
| 2,913,749 | 11/1959 | Ayres | 401/272 X |
| 2,996,750 | 8/1961 | Chalet | 401/206 |
| 3,397,939 | 8/1968 | Berry | 401/205 X |
| 4,453,651 | 6/1984 | Braithwaite et al. | 401/264 X |
| 4,693,623 | 9/1987 | Schwartzman | 401/206 |

*Primary Examiner*—Danton D. DeMille

*Attorney, Agent, or Firm*—Jacobson, Price, Holman & Stern

[57] ABSTRACT

An ink reservoir and a slide plug are slidably provided in a pen barrel. The ink reservoir is filled with liquid ink. The slide plug divides the interior of the pen barrel into an ink region and an air region. A writing tip is provided in the distal end portion of the pen barrel so as to be movable axially. An elastically deformable diaphragm member is provided in the pen barrel. The diaphragm member divides the interior of the pen barrel into a writing tip side region and an ink reservoir side region and is elastically deformed toward the ink reservoir when a writing pressure is applied to the writing tip. The diaphragm member is formed with an opening which opens to cause the ink reservoir to communicate with the writing tip when the diaphragm member is elastically deformed. Upon writing, the diaphragm member is elastically deformed to pressurize the ink in the ink reservoir. In this case, the slide plug slides to restrict the upper limit of the ink pressure to a predetermined value. Ink under the predetermined pressure is supplied from the ink reservoir to the writing tip through the opening.

1 Claim, 6 Drawing Sheets

WRITING INSTRUMENT

BACKGROUND OF THE INVENTION

1. Field of the Invention

This invention relates to a writing instrument such as a felt-tip pen, a marker including a white board marker, or the like, and more particularly to a writing instrument having an ink supplying mechanism which supplies liquid ink directly stored in an ink reservoir to the writing tip of the writing instrument by such a required amount that is used in each writing.

2. Description of the Related Art

In the conventional writing instrument such as a felt tip pen, ink enters and is held due to capillary attraction in the spaces between fibers of a fibrous member filled in the ink reservoir in the barrel of the pen. With this conventional pen, however, the amount of ink held in the ink reservoir is small and the flow rate of ink supplied from the fibrous member to the writing tip such as a felt tip is extremely small. Thus, ink is used up very shortly and becomes faded when the writer writes quickly with the pen. In order to supply ink from the fibrous member to the writing tip, the capillary force of the writing tip which absorbs the ink must be larger than the capillary force of the fibers of the fibrous member. Thus, only the writing tip which has a large capillary force, such as a felt tip or the like, is used.

To overcome these disadvantages, there has been developed a writing instrument in which liquid ink is directly filled in an ink reservoir without using a fibrous material and a slide plug is provided in the pen barrel such that the slide valve divides the interior of the pen barrel into an air region and an ink region and moves toward the ink region as the ink is used.

With the pen of this direct filling type, a large amount of ink can be contained in the ink reservoir, the flow rate of ink supplied to the writing tip is fundamentally not restricted, and the capillary force which the writing tip absorbs ink is not limited either. Thus, this pen has an advantage that a ball point tip for aqueous ink which has a small capillary force or any other type of writing tip can be used.

However, the pen of direct filling type requires a mechanism which supplies, from the ink reservoir to the writing tip, the amount of aqueous ink corresponding to the amount of ink used at the writing tip upon writing. This ink-supply controlling mechanism must be designed such that it supplies to the writing tip a very small amount of ink which correspond to the amount of ink used at the writing tip upon writing and, when the temperature and/or the atmospheric pressure changes, the mechanism prevents excessive pushing out of the ink reservoir from the writing tip (which causes the dripping of ink) and reversely absorption of air into the ink reservoir through the writing tip. The ink supplying mechanisms of this kind are broadly classified into a differential pressure type and a pump type.

The ink-supply controlling mechanism of differential pressure type is provided between the writing tip and the ink reservoir with a valve mechanism which opens when a predetermined pressure difference occurs. More specifically, when ink is used at the writing tip upon writing, the writing tip absorbs ink from the ink reservoir due to the capillary force of the writing tip and a pressure difference occurs between the writing tip and the ink reservoir. When the pressure difference becomes equal to the predetermined value or more than that, the valve mechanism opens, whereby a proper amount of ink is supplied from the ink reservoir to the writing tip. In case writing is not made, the valve mechanism is closed to interrupt communication between the ink reservoir and the writing tip in such a manner that ink is protected from dripping from the writing tip even when the ink in the ink reservoir is expanded or air is prevented from being absorbed in the ink reservoir through the writing tip even when the ink in the ink reservoir shrinks. The expansion and shrinkage of ink in the ink reservoir is compensated by the movement of the slide plug.

The writing tip of the writing instrument having the ink-supply controlling mechanism of differential pressure type must have at least capabilities of opening the valve mechanism of the ink-supply controlling mechanism and causing the slide plug to slide against its sliding resistance. Actually, some ball point tips for aqueous ink lack an ink-absorbing force if they are not suitably designed. In order for such writing instrument have a stable writing characteristic, only a felt to having a high ink-absorbing force can be used.

Quick-drying alcoholic ink is used for a white board marker or the like. Recently, quick-drying alcoholic ink has been developed used in a writing instrument with which writing is made on paper. Such alcoholic ink, however, has a poor wetting characteristic on the surface of an object on which writing is made and sometimes too small a capillary force to provide a sufficient ink-absorbing force.

When the ink-supply controlling mechanism of pump type is employed, the writing tip is adapted to slide along the pen barrel. The controlling mechanism has a pump mechanism, provided in the pen barrel, for supplying a predetermined amount of ink from the ink reservoir to the writing tip due to the sliding of the writing tip. When a writing pressure is exerted on the writing tip upon writing, the writing tip is moved such that ink is pushed out from the ink reservoir to the writing tip by means of the pump mechanism.

This pump type mechanism operates in a simple way and does not require the capillary force of the writing tip. Thus, the writing instrument provided with this mechanism has an advantage that the kind of writing tip and ink is not limited. However, the ink used in one time of writing is very small and it is difficult to design the pump mechanism which supplies this small amount of ink accurately.

Since the pump mechanism is operated in accordance with the movement of the writing tip caused by the writing pressure, the amount of ink coming out of the writing tip differs from a writing pressure to a writing pressure. Some writers write small letters with a strong touch and some others write large letters with a week touch. In the former case, an amount of ink more than that used upon writing is supplied to the writing tip. As the writing is continued, an excess amount of ink is supplied to the writing tip and ink drips therefrom. In the latter case, on the other hand, an amount of ink less than that used upon writing is supplied to the writing tip is delivered by the pump mechanism to the writing tip. As the writing is continued, an insufficient amount of ink is supplied to the writing tip and ink becomes faded.

Both conventional ink-supply controlling mechanisms are provided in the pen barrels, they must be rendered compact and manufactured at a low cost when the are used in throwaway writing instruments. Thus, it is difficult to develop an ink-supplying mechanism which satisfies all the above-mentioned requirements so long as any of the conventional ink-supply controlling mechanisms is employed.

SUMMARY OF THE INVENTION

The object of this invention is to provide a writing instrument with an ink reservoir directly filled with aqueous ink, wherein an exact amount of ink corresponding to the amount of ink used upon writing is supplied from the ink reservoir to the writing tip, the structure is simple, the manufacturing cost is low, the operation is accurate, dripping of ink and absorption of air into the ink reservoir are ensured to be prevented, and kinds of pen tips and ink are not limited.

In order to achieve this object, a writing instrument according to this invention comprises an ink reservoir containing liquid ink, a slide plug slidably provided in the ink reservoir for sealing the ink reservoir in a fluids tight fashion, and a writing tip such as a felt tip, which is slidable along the pen barrel. In the pen barrel is provided an elastically deformable diaphragm member which divides the interior of the ink barrel into an ink reservoir side region and a pen side region. When a writing pressure is applied to the writing tip by writing with the writing instrument, the writing tip is retracted and the diaphragm member is elastically deformed toward the ink region such that the ink in the ink reservoir is pressed. The diaphragm member has an opening which opens when the diaphragm member is deformed toward the ink reservoir.

When a writing pressure is exerted on the writing tip upon writing, the writing tip is retracted and the diaphragm member is elastically deformed toward the ink reservoir. The volume of the ink reservoir is reduced, the pressure in the ink reservoir is increased and the opening of the diaphragm member opens such that ink is delivered under pressure through the opening from the ink reservoir to the writing tip- The elevated pressure in the ink reservoir due to the deformation of the diaphragm member causes the slide plug to slide. The increment of the elevated pressure in the ink reservoir corresponds to the pressure caused by the sliding resistance of the slide plug when the plug slides, and thus the pressure in the ink reservoir is not raised to the value more than the pressure caused by the sliding resistance of the plug. It is noted, therefore, that the increment of the raised pressure is limited to the predetermined value corresponding to the sliding resistance of the slide plug even when a writing pressure is strong or weak. This results in the facts that a suitable and constant amount of ink is supplied to the writing tip and stable writing becomes possible regardless of writing pressures and writer's handwriting peculiarity.

According to the preferred embodiments of this invention, the opening opens after the diaphragm member has been deformed and the slide plug has begun to slide. In other words, the opening opens after the slide plug has begun to slide, its sliding resistance has been turned into a stable dynamic frictional resistance and the pressure in the ink reservoir region has become stable. Thus, the ink pressure which is being delivered to the writing tip is made constant, and the amount of ink supplied to the writing tip is accurately and stably controlled.

When no writing pressure is applied to the writing tip, namely, writing is not made, the opening of the diaphragm member is completely closed to interrupt the communication between the ink reservoir and the writing tip. In this regards, even when the atmospheric pressure and/or temperature changes, such phenomenon as ink in the ink reservoir is pushed out of the writing tip so as to drip therefrom and air is introduced from the writing tip to the ink reservoir are prevented.

This writing instrument is not limited by the kinds of ink and pen tips which have different capillary forces. Further, this instrument has a simple structure, is manufactured at a low cost and is suited for a throwaway type.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
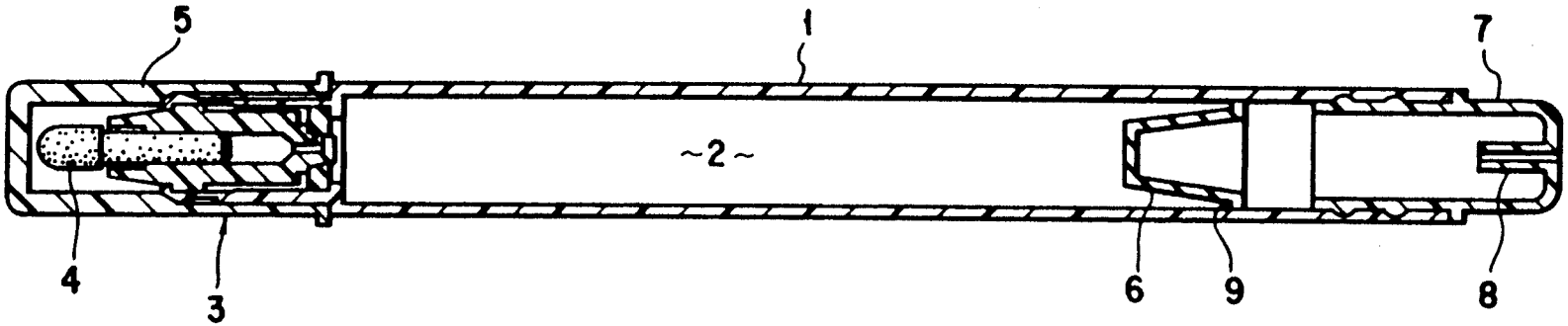
FIG. 1 is a longitudinal cross-sectional view of the overall first embodiment of this invention.
Figure 2:
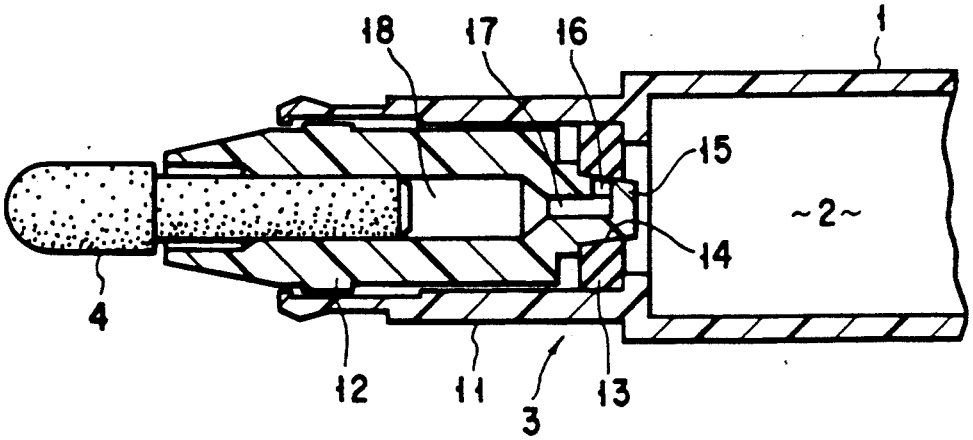
FIG. 2 is an enlarged longitudinal cross sectional view of part of the first embodiment.
Figure 3:
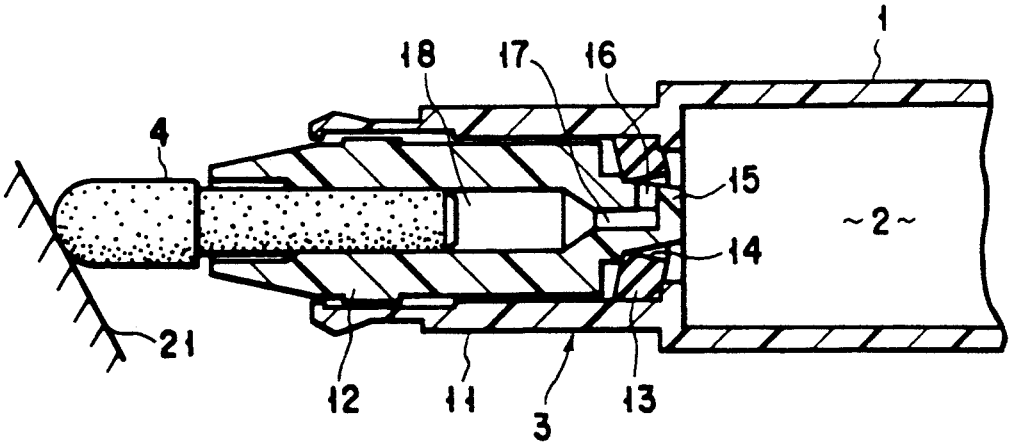
FIG. 3 is an enlarged longitudinal cross-sectional view of part of the first embodiment in another operating condition.

This invention will be described by way of the preferred embodiments with reference to the accompanying drawings. The first embodiment of this invention is shown in FIGS. 1 to 3. This embodiment relates to a white board marker using quick-drying alcoholic ink.

FIG. 1 is shows an overall white board marker. In a pen barrel 1 is formed a cylindrical ink reservoir 2 which is filled with liquid ink. On the distal end portion of the pen barrel 1 is mounted an ink-supply controlling mechanism 3 for supplying a moderate amount of ink from the ink reservoir 2 to a writing tip (in this case, a felt tip 4). A cap is designated at 5.

A slide plug 6 is fitted slidably and in a fluid tight fashion in the proximal end portion of the ink reservoir 2. The slide plug 6 is designed such that it slides on the inner surface of the ink reservoir 2 with a predetermined sliding resistance. In the proximal end of the pen barrel 1 is mounted an end plug 7 which causes the interior of the pen barrel 1 to communicate with the atmosphere through a vent 8 formed in the end plug 7.

The slide plug 6 is made of elastic material such as silicone rubber and has a cylindrical form. On the outer periphery of the slide plug 6 is formed a flange-like sealing portion 9 which slides on the inner surface of the ink reservoir 2 to establish liquid tightness. As ink in the ink reservoir 2 is consumed in this arrangement, the slide plug 6 slides toward the distal end of the pen barrel 1 whereby the pressure in the ink reservoir 1 is maintained at substantially the same value as the atmospheric pressure. In the portion of the pen barrel 1 between the slide plug 6 and end plug 7 is contained a small amount of a lubricant such as ethylene glycol which ensures sealing and smooth sliding of the slide plug 6. When the slide plug 6 is retracted, the lubricant is introduced between the sealing outer surface of the slide plug 6 and the inner surface of the ink reservoir 2 such that the resistance of the slide plug 6 is reduced when it advances again and ink marks on the inner surface of the ink reservoir 2 is removed.

The structure of the ink-supply controlling mechanism 3 will now be described with reference to FIGS. 2 and 3. On the distal end of the pen barrel 1 is formed a slide guiding portion 11 in which a slide holder 12 is axially slidably guided. The felt tip 4 is fixedly mounted in the distal portion of the slide holder 12.

In the proximal end of the slide guide 11 is fixedly mounted a disk-like diaphragm member 13 made of elastic material such as silicone rubber. The outer peripheral surface of the diaphragm member 13 closely contacts the inner peripheral surface of the proximal end portion of the slide guide 11 to effect fluid tightness therebetween. It follows that the diaphragm member divides the passage of ink or the pen barrel 1 into an ink reservoir side region defined by the ink reservoir 2 and an writing tip region at which the felt tip or writing tip 4 is located.

A circular opening 14 is formed in the central portion of the diaphragm member 13. A cylindrical engagement projection 15 projects from the central portion of the proximal end of the slide holder 12. The engagement projection 15 elastically engages the opening 14 such that the inner edge of the opening 14 is closely fitted on the outer peripheral surface of the engagement projection 15.

An axial passageway 17 is formed in the center of the engagement projection 15. From the proximal portion of the axial passageway 17 extends a radial opening 16 which opens at the predetermined position of the outer peripheral surface of the engagement projection 15. The passageway 17 communicates with the felt tip 4 via a communication passageway 18.

When a writing pressure is not exerted on the felt tip 4, namely, no writing is made, the diaphragm member 13 is not elastically deformed and the inner peripheral surface of the opening 14 of the diaphragm member 13 closely contacts the outer peripheral surface of the engagement projection 15 of slide holder 12 to close the opening 16 opening at the outer peripheral surface of the projection 16, as shown in FIG. 2. In this state, communication between the ink reservoir 2 and the felt tip 4 is interrupted.

When the writer writes with this white board marker, the felt tip 4 is pressed against a white board 21 and a writing pressure is applied on the felt tip 4, as shown in FIG. 3. The writing pressure causes the slide holder 12 to retard and the diaphragm member 13 is deformed toward the ink reservoir 2, as shown in FIG. 3. The deformation of the diaphragm member 13 reduces the volume of the ink reservoir 2 thereby increasing the pressure in the ink reservoir 2. The increment of the elevated pressure in the ink reservoir 2 corresponds to the sliding resistance of the retarding slide plug 6. Since the diaphragm member 13 is deformed into a substantially conical shape toward the ink reservoir 2, the opening 14 in the central portion of the diaphragm member 13 is also formed into a substantially conical shape, and the inner peripheral surface of the opening 14 is separated from the outer peripheral surface of the engagement projection 15 of the slide holder 12. The opening 16 at the outer peripheral surface of the engagement projection 15 is opened whereby the opening 16 at the outer peripheral surface of the engagement projection 15 is released. As a result, the ink reservoir 2 communicates with the felt tip 4 through the opening 16, the passageway 17 and the communication passageway 18 such that ink is supplied from the ink reservoir 2 to the felt tip 4 via these elements 16, 17 and 18.

The timing at which the opening 16 of the outer peripheral surface of the engagement projection 15 is opened by the deformation of the opening 14 in the center of the diaphragm member 13 is set such that the release of the opening 16 is delayed from the commencement of deformation of the diaphragm member 13. The time of the commencement of deformation of the diaphragm member 13 and the timing of the release of the opening 16 can arbitrarily be set according to the shape of the diaphragm member 13 and the engagement projection 15 and the like. For example, the timing can be set according to the initial radial compression of the diaphragm member 13 which occurs when the diaphragm member 13 is pressed in the pen barrel 1. The more is the initial radial compression of the diaphragm member 13, the more is delayed the timing of the release of the opening 16. Further, the timing can be set according to the axial position of the opening 16. The more forwardly is positioned the opening 16, the more is delayed the timing of the release of the opening 16.

Figure 4:
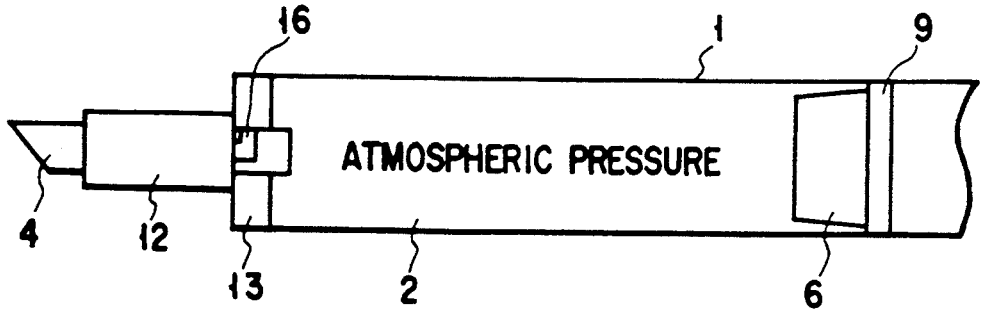
FIGS. 4 to 9 are general views illustrating the operation of the first embodiment.

The operation of the writing instrument according to this invention will now be described with reference to FIGS. 4 to 9. FIG. 4 shows the state in which writing is not made. In this case, the diaphragm member 13 is not yet deformed and the opening 14 closely contacts the outer peripheral surface of the engagement projection 15 of the slide holder 12 so as to be in a closed state. In this state, the communication between the ink reservoir 2 and the felt tip 4 is completely interrupted. For this reason, dripping of ink from the felt tip 4 and the entrance of air in the ink reservoir 2 through the felt tip 4 are completely prevented even if ink in the ink reservoir 2 expands and shrinks. In this case, the expansion and shrinkage of ink are compensated by the sliding of the slide plug 6.

Figure 5:
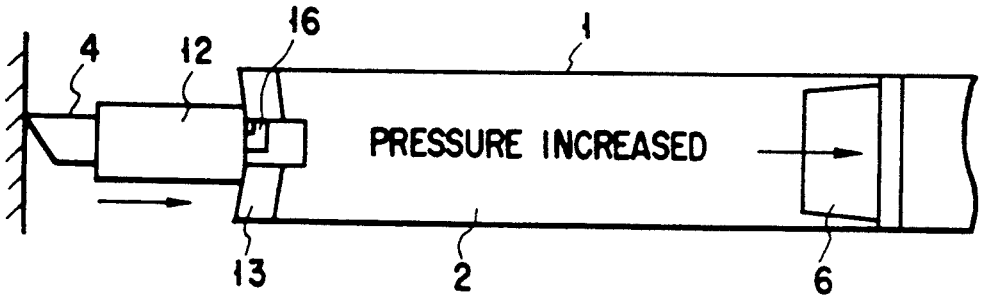

In FIG. 5 is shown the state in which writing commences with the writing instrument according to this embodiment. When the felt tip 4 of the writing instrument is pressed against a white board, the slide holder 12 is retracted under the writing pressure and the deformation of the diaphragm member 13 commences. In this state, the opening 16 is not yet opened, and the deformation of the diaphragm member 13 presses the ink in the ink reservoir 2 so as to raise the pressure of the ink. Then, the slide plug 6 begins to slide under this pressure. In a stationary state, the outer peripheral surface of the sealing portion 9 of the slide plug 6 closely contacts the inner peripheral surface of the ink reservoir 2, and no lubricant film or ink film exists between these sealing surfaces. This means that the initial sliding resistance of the slide plug 6 is considerably large. The initial sliding resistance rather varies due to manufacturing errors and the degree of close contact of the seal portion 9 with the inner surface of the ink reservoir 2.

When, however, the pressure in the ink reservoir 2 increases as described above, ink enters part of the space between the sealing surfaces and an ink film is formed there. As the pressure causes the slide plug 6 to begin sliding, an ink film and a lubricant film are formed in the whole space between the seal surfaces. In this state, the sliding resistance of the slide plug 6 is reduced and takes a stable value. FIG. 5 shows a state of the writing instrument a very short time after the felt tip 4 began contacting the white board or the like.

Figure 6:
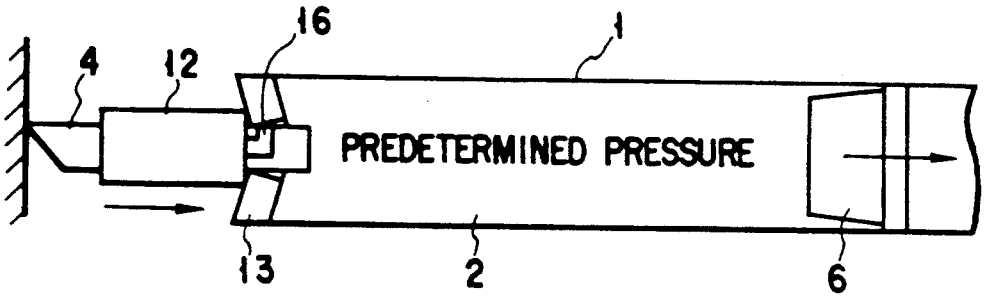

As a writing pressure becomes stronger as shown in FIG. 6, the diaphragm member 13 is elastically deformed more. Then, the opening 16 is opened and the ink reservoir 2 communicates with the felt tip 4. In this state, since the slide plug 6 has already slid, the sliding resistance thereof is stable and the pressure in the ink reservoir 2 is a stable predetermined pressure. Therefore, an accurate amount of ink is supplied from the ink reservoir 2 to the felt tip 4.

Figure 7:
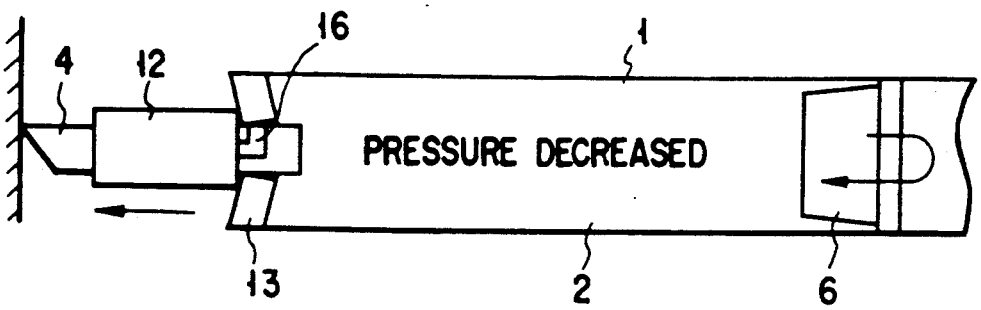

When the writing is finished, the felt tip 4 begins to be separated from the surface of the white board. As shown in FIG. 7, the diaphragm member 13 begins to return due to its elasticity with the opening 16 opened, and the volume of the ink reservoir 2 begins to increase. The pressure in the ink reservoir 2 begins to decrease and the slide plug 6 stops. Thereafter, the pressure in the ink reservoir 2 becomes negative, and the slide plug 6 begins to advance under this negative pressure. The negative pressure generated in the ink reservoir 2 tries to absorb ink in the felt tip 4 into the ink reservoir 2. As the amount of ink included in the felt tip 4 decreases, however, the ink absorbing force (a capillary force) of the felt tip 4 increases, and the resistance against the ink absorbing force of the ink reservoir 2 increases, whereby only some extent of ink contained in the felt tip 4 is absorbed by the ink reservoir 2.

At the initial stage, this ink absorbing action does not cause a disadvantage against the conventional writing instrument, but allows for absorption of surplus ink for a white board marker and can make the writing characteristic stable. More specifically, the surface of a white board has no water absorption capability and no ink absorption capability. When the writer writes on a white board with a white board marker, the amount of ink which should be supplied to the felt tip 4 might be as large as possible within a range in which the disadvantage such as the dripping of ink does not occur in order to obtain thick and clear writing. When writing is continued for a long time, however, the amount of ink contained in the felt tip 4 becomes larger and larger, and finally ink tends to drip. With this invention, however, surplus ink contained in the felt tip 5 is absorbed into the ink reservoir 2 every time writing is finished. Thus, there is no possibility that ink drips or other disadvantages occur even if writing is continued for a long time.

Figure 8:
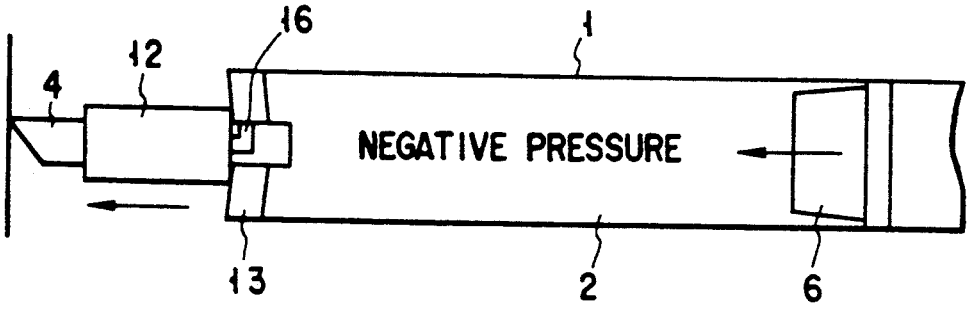

As shown in FIG. 8, when the diaphragm member 13 returns further, the slide 6 advances further. The opening 16 is closed and ink absorption completely stops.

Figure 9:
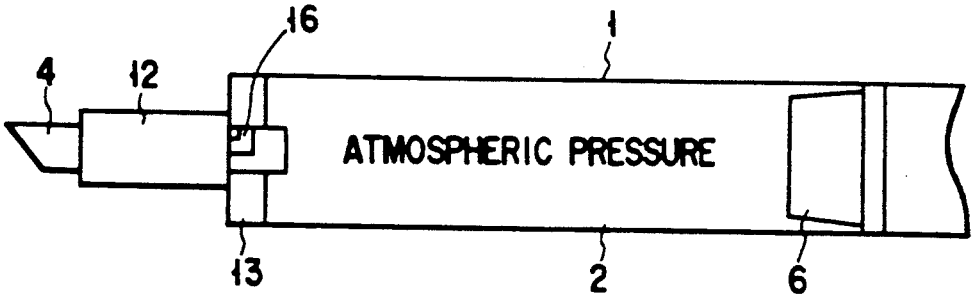

As shown in FIG. 9, after the felt tip 4 has been separated from the white board, the diaphragm member 13 is fully returned, the slide plug 6 stops, the pressure in the ink reservoir 2 becomes equal to the atmospheric pressure, and the writing instrument returns to the state shown in FIG. 4.

Figure 10:
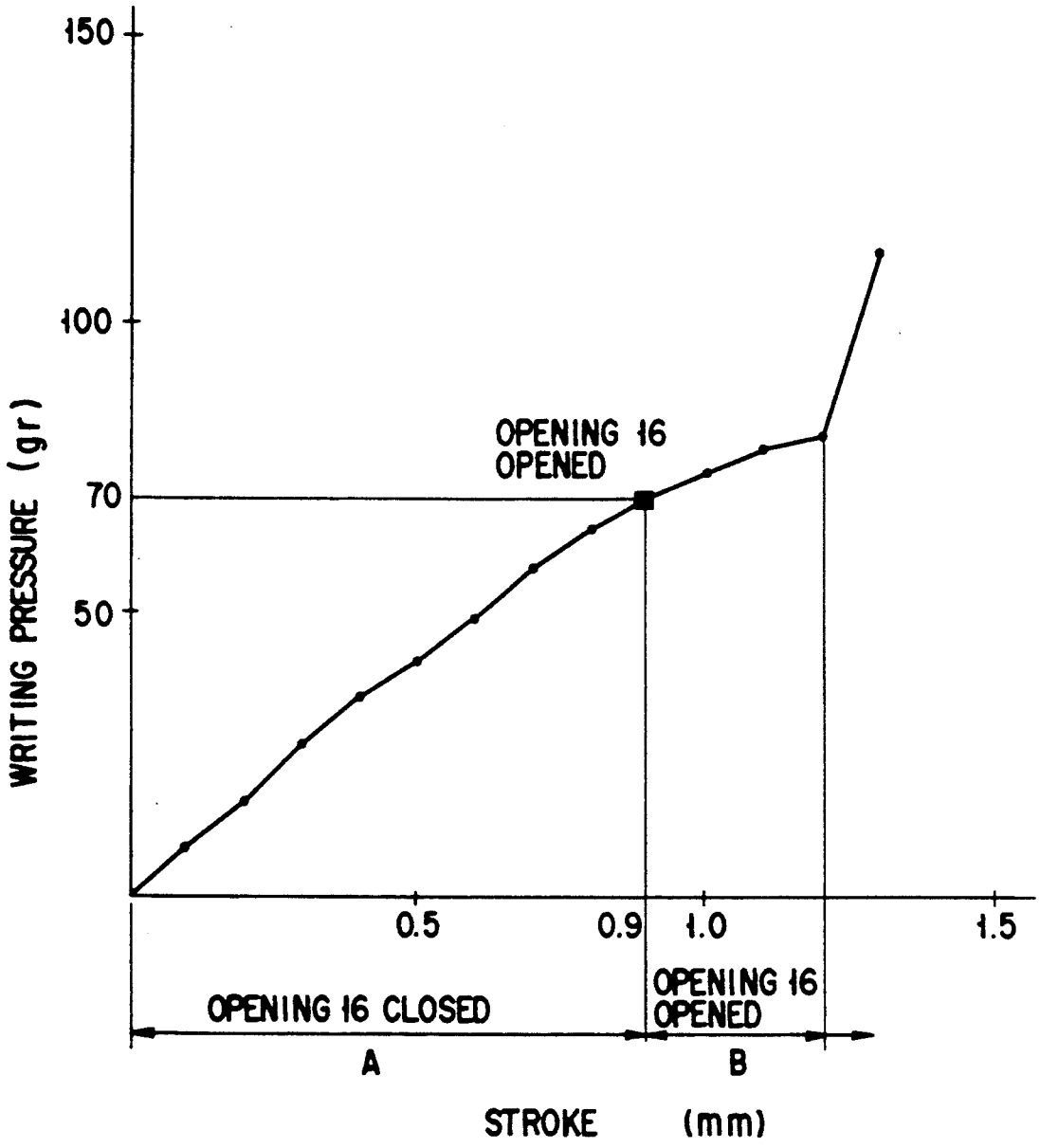
FIG. 10 is a graph showing the operational characteristic of the first embodiment.

FIG. 10 shows an example of the timing of the opening of the opening 16 in connection with the stroke of the elastic deformation of the diaphragm member 13 and the writing pressure when a white board marker according to this invention is employed. In this example, the opening 16 is set to open when the writing pressure is 70 g and the stroke is 0.9 mm and the arrangement is designed such that the writing pressure, i.e., the reaction of the diaphragm member 13 and the like rapidly increases when the stroke is about 1.2 mm. It is understood that the stroke range A is the range in which the opening 16 is not opened, i.e, ink is not supplied to the felt tip 4, and the stroke range B is the range in which the opening 16 is opened, i.e., ink is supplied to the felt tip 4. These settings were made such that kinds of letters and writers' handwriting peculiarity do not influence the proper ink supply.

More specifically, writing does not commence, i.e., the writing tip does not begin to be moved just after the writing tip contacts the written surface upon writing, but writing timing is delayed to some extent. The writing starts after the writing pressure has been increased to some extent. The writing pressure which is also a pressure for moving the writing tip of a writer who writes with a weak writing pressure is about 70 g. With the writing instrument having the characteristic as shown in FIG. 10, the reaction rapidly increases at the stroke of about 1.2 mm or more and the instrument is designed such that the stroke range at which ink is supplied to the writing tip is not increased so much. In this regard, ink exhaustion due to the movement of the writing tip occurs in the range B for both the writers who write with a strong writing pressure and a weak writing pressure. The range B does not change so much as described above. This setting allows for substantially same thickness of writing for both a weak pressure and a strong pressure.

This setting is made for writing characters such as Chinese characters which have short lines and writing tip is separated fully from the written surface every time writing is finished. When characters such as English characters which have long lines, the above-mentioned setting must be modified so as to accord with the nature of such characters. It is preferred that the stroke range B be made wider than the example shown in FIG. 10 when white board markers are used in the English territories. Needless to say, this setting can be suitably modified according to the kinds of writing surfaces, pen tips, ink and the like.

Since a white board has no water absorbing capacity, the thickness of ink on the written surface is greatly influenced by the amount of ink supplied to the writing tip when a white board marker of this invention is used. However, the thickness of ink transcribed on paper with writing instruments and the thickness of ink transcribed on a written surface with felt tip pens using aqueous ink are not influenced so much by the amount of ink supplied to the writing tip. Thus, it is unnecessary to consider the timing of releasing the opening, etc. strictly when the white board marker of this invention is used.

Figure 11:
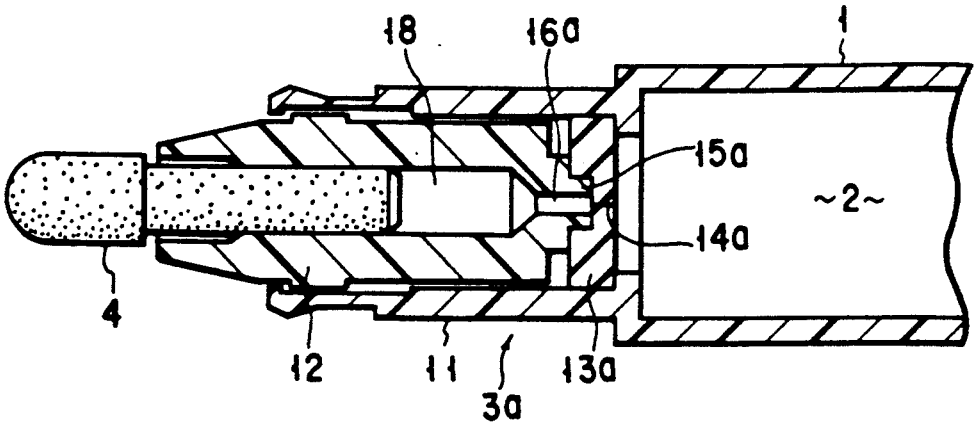
FIG. 11 is an enlarged longitudinal cross-sectional view of part of the second embodiment.
Figure 12:
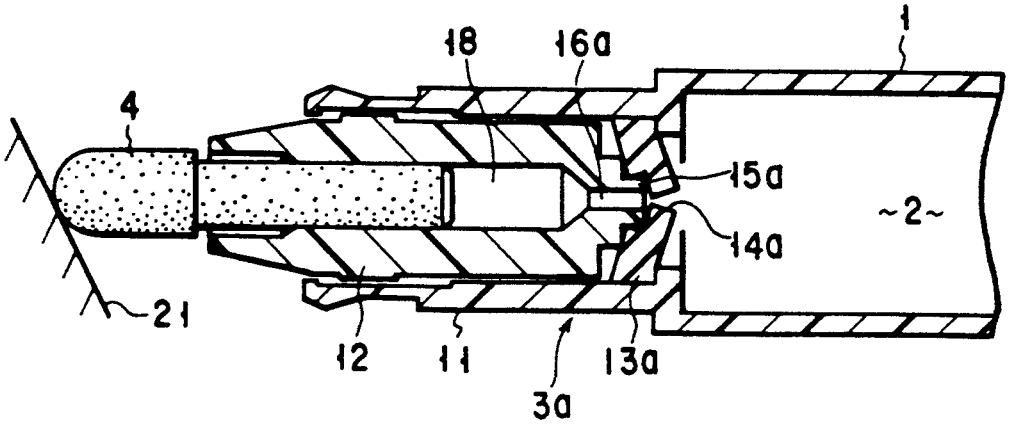
FIG. 12 is an enlarged longitudinal cross-sectional view of part of the second embodiment in another operational condition.

This invention is not limited to the first embodiment. For example, an ink-supply controlling mechanism **3*a* having another structure is shown in FIGS. 11 and 12. The projecting length of an engagement projection 15*a* projecting from the distal end of a slide holder 12 is smaller than the thickness of a diaphragm member 13***a* and the engagement projection 15*a* does not pass through the diaphragm member 13*a*. In the center of the engagement projection 15*a* is formed an axial opening 16*a* which opens at the distal end surface of the engagement projection 15*a*. In this embodiment, an opening 14*a* comprising a linear notch or cross formed notches is formed in the central portion of the diaphragm member 13*a*, for example.

When writing is not made with the writing instrument according to the second embodiment, the opposed edges of the opening 14*a* of the diaphragm member 13*a* are closely contacted together by the elastic force such that the opening 14*a* is closed, as shown in FIG. 11. When the writing is made, the opening 14*a* is opened by the elastic deformation thereby causing the ink reservoir 2 to communicate with the felt tip 4, as shown in FIG. 12.

Since the opening 16*a* opens axially in this embodiment, dies having a simple structure can be used when the slide guide 12 is manufactured from synthetic resin or the like. The writing instrument according to the second embodiment has the same structure as the writing instrument according to the first embodiment except for the above-mentioned differences. Thus, the identical parts and elements of the second embodiment to those of the first embodiment are designated by the same referential numerals used in the first embodiment, the description thereof being omitted.

Figure 13:
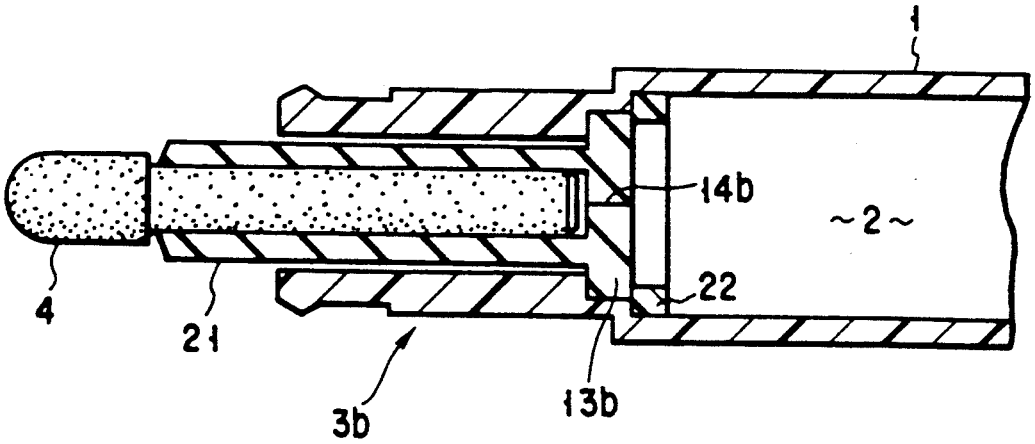
FIG. 13 iS an enlarged longitudinal cross-sectional view of part of the third embodiment.

The third embodiment of this invention is shown in FIG. 13. A hollow cylindrical holder portion 21 projects from the central portion of a diaphragm member 13*a* toward the distal end of a pen barrel 1. A felt tip 4 is inserted into and held in the holder portion 21. The holder portion 21 is adapted to be slidable in the axial direction of the pen barrel 1. When a writing pressure is applied to the felt tip 4 upon writing, the holder portion 21 is retracted, and the diaphragm member 13*a* is elastically deformed toward the ink reservoir 2. A linear or cross shaped opening 14*a* is formed in the central portion of the diaphragm member 13*a* as in the case of the second embodiment. When a writing pressure is not exerted, the opposed edges of the opening 14*b* are closely contacted together such that the opening 14*b* is closed. When a writing pressure is applied to cause the diaphragm member 13*a* to be elastically deformed, the opening 14*b* is opened and the ink reservoir 2 communicates with the felt tip 4.

The operation of the third embodiment is same as that of the first and second embodiments. With the third embodiment, the diaphragm member is made integrally with the holder portion, making the structure simple and being manufactured at a low cost.

This invention is not limited to the above-mentioned embodiments, either. For example, this invention is not restricted to a white board marker but is applicable to a felt tip pen using aqueous ink, a ballpoint pen using aqueous ink, a paint marker, a nail marker with which manicure is applied to nails and a general writing instrument. The writing tip is not limited to a felt tip but may be any other type of writing tip. The ink may be aqueous ink, oil ink, alcoholic ink or any type of ink. In case the opening comprises a notch or notches, ink does not flow out when the writing tip is pulled off the diaphragm member. Thus, the ink reservoir and the diaphragm member are manufactured separately from the pen barrel, thereby making the combination of the former elements an interchangeable ink cartridge.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A writing instrument including a pen barrel having an interior, a distal end portion and a proximal end portion; an ink reservoir formed in said pen barrel and directly filled with liquid ink; and a slide plug sladable in said ink reservoir in a liquid tight fashion according to consumption of ink in said ink reservior, for dividing said interior of said pen barrel into an air region and an ink region defining said ink reservoir, said writing instrument further comprising:

a writing tip provided in said distal end portion of said pen barrel so as to be movable axially of said pen barrel;

a diaphragm member made of elastic material, and dividing said interior of said pen barrel into a writing tip region and said ink region, said diaphragm member being adapted to be elastically deformed toward said ink reservoir to reduce the volume of said ink reservoir when a writing pressure is applied to said writing tip; and an opening formed in said diaphragm member and opened to cause said ink reservoir to communicate with aid writing tip when said diaphragm member is elastically deformed toward said ink reservoir, said pen barrel being provided with an axially slidable slide holder having a distal portion and a proximal end, said writing tip being attached to said distal portion of said slide holder, said slide holder having an engagement projection axially extending from said proximal end of said slide holder such that said engagement projection is elastically engaged with a central portion of said diaphragm member, said writing tip being retracted together with said slide holder so as to elastically deform said diaphragm member toward said ink reservoir when a writing pressure is applied to said writing tip, said opening being a hole formed in said central portion of said diaphragm member, said engagement projection extending through said opening and elastically fitted therein, said engagement projection being provided in an outer peripheral surface thereof with another opening communicating with said writing tip, and said opening being expanded to be separated from said outer peripheral surface of said engagement projection and said another opening being opened to cause said writing tip to communicate with said ink reservoir, when said diaphragm member is elastically deformed toward said ink reservoir.

* * * * *